US007294014B2

(12) United States Patent
Drescher et al.

(10) Patent No.: US 7,294,014 B2
(45) Date of Patent: Nov. 13, 2007

(54) ELECTRICAL PLUG CONNECTOR

(75) Inventors: Thomas Drescher, Hueckeswagen (DE); Andreas Urbaniak, Muenster (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/342,732

(22) Filed: Jan. 30, 2006

(65) Prior Publication Data

US 2006/0172587 A1 Aug. 3, 2006

(30) Foreign Application Priority Data

Jan. 31, 2005 (GB) ..... 0501761.1
Aug. 16, 2005 (EP) ..... 05013615

(51) Int. Cl.
*H01R 3/00* (2006.01)

(52) U.S. Cl. ..... 439/489

(58) Field of Classification Search ..... 439/488, 439/489

See application file for complete search history.

(56) References Cited

U.S. PATENT DOCUMENTS 5,147,221 A * 9/1992 Cull et al. ..... 439/585
2001/0049216 A1 12/2001 Chieko et al.

FOREIGN PATENT DOCUMENTS

GB 2381392 4/2003
WO 2004004071 1/2004

* cited by examiner

*Primary Examiner*—Briggitte R. Hammond
(74) *Attorney, Agent, or Firm*—David P. Wood

(57) ABSTRACT

The invention relates to an electrical plug connector comprising a first plug part, a second plug part which can be plugged together with the first plug part and an insertion part which is supported displaceably at the first plug part in the plug-in direction and cooperates with at least one spring element of the first plug part, with the insertion part being able to be pushed into the first plug part by the second plug part against the restoring force of the spring element on the plugging together of the plug parts, and with the spring element being substantially relaxed with separated plug parts and in the completely plugged together state of the plug connector.

13 Claims, 6 Drawing Sheets

Figure 1:
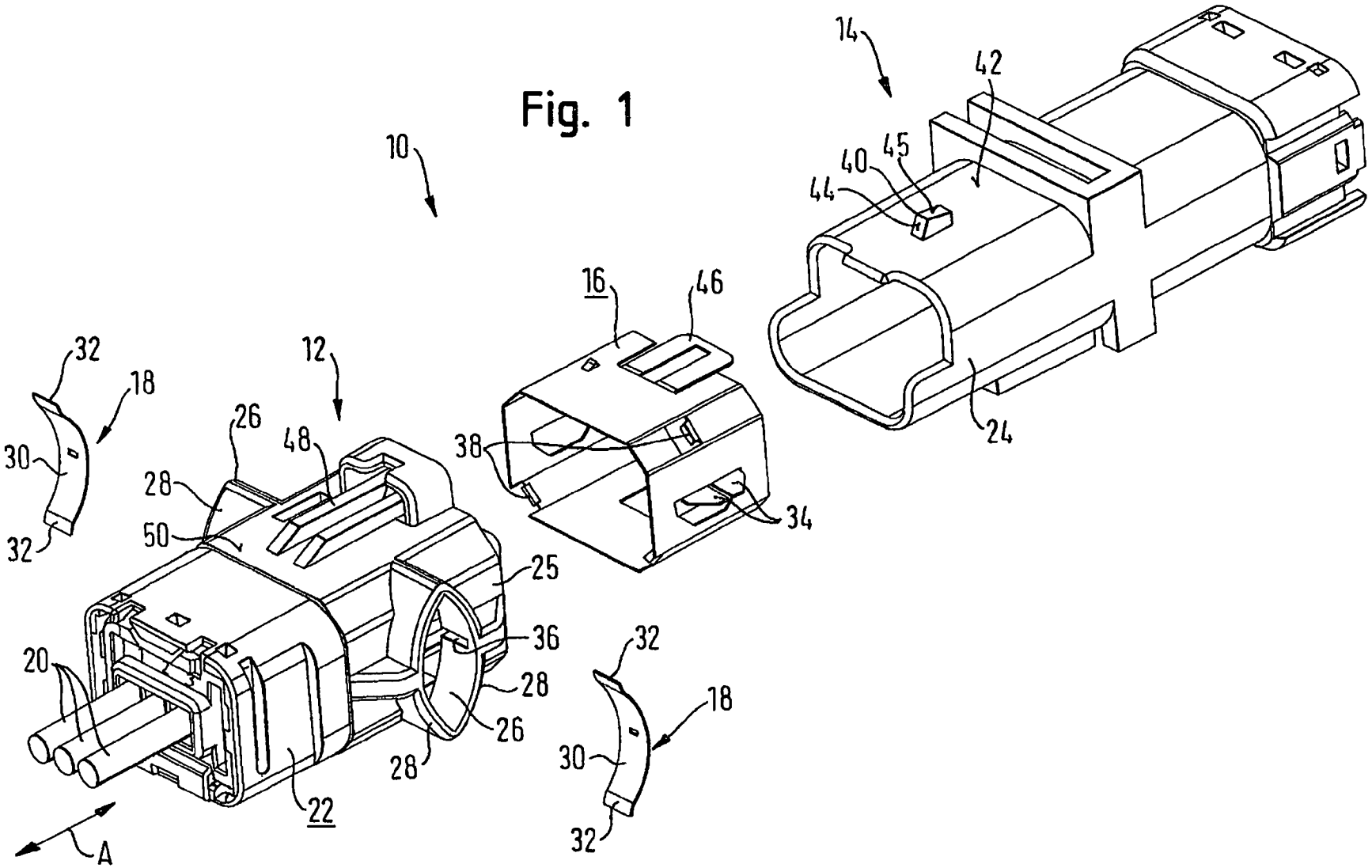

14
12
20
22
24
25
26
28
30
32
34
36
40
42
44
45
48
50
18

ELECTRICAL PLUG CONNECTOR

The invention relates to an electrical plug connector comprising a first plug part and a second plug part which can be plugged together with the first plug part.

It is known to provide a plug connector of this type with a go/no go mechanism which includes a spring which is tensioned on the plugging together of the plug parts and prevents a permanent connection of the plug parts as long as the plug parts have not reached a relative position in which the plug connector is completely plugged together.

It is the underlying object of the invention to provide an electrical plug connector having a go/no go mechanism which permanently ensures a reliable function of the plug connector.

An electrical plug connector having the features of claim 1 is provided to satisfy this object.

The plug connector in accordance with the invention includes a first plug part, a second plug part which can be plugged together with the first plug part and an insertion part which is supported displaceably at the first plug part in the plug-in direction and which cooperates with at least one spring element of the first plug part. The insertion part can be pushed into the first plug part by the second plug part against the restoring force of the spring element on the plugging together of the plug parts The spring element is substantially relaxed with separated plug parts and in the completely plugged together state of the plug connector.

The expression "substantially relaxed" means here that no significant force is exerted onto the insertion part by the spring element. When the spring element is substantially relaxed, it is in a position which is also termed the position of rest in the following. The spring element adopts a position of rest of this type both in the separated state and in the completely plugged together state of the plug connector. Since the separated state and the completely plugged together state of the plug connector are the most frequently occurring states in practice, the spring element is predominately in a relaxed state. The desired spring properties of the spring element, a reliable go/no go function and ultimately a reliable function of the plug connector overall are thereby permanently ensured overall.

When the plug parts are joined together, the spring element is tensioned in that the insertion part is pushed into the first plug part against the restoring force of the spring element. As long as the plug parts are not completely joined together, a second plug part not acted on by a sufficiently large plug-in force is at least partly pushed out of the first plug part again by the spring element. It can thereby be directly recognized whether the plug connector is plugged together correctly or not.

The completely plugged together state of the plug connector is here understood to be a relative position of the plug parts in which electrical connection elements of the first plug part and electrical connection elements of the second plug part are correctly connected to one another. In contrast, the expression "separation of the plug parts" here only means that there is no longer any electrical connection between the electrical connection elements of the two plug parts. The state of the separated plug parts thus includes a relative position of the plug parts in which the second plug part is still plugged at least sectionally in the first plug part.

A certain freedom in the design of the plug parts results from the fact that the second plug part does not cooperate directly with the spring element but only indirectly via the insertion part. The interplay of insertion part and spring element, i.e. the go/no go function of the plug connector is in particular essentially independent of the geometry of the first and second plug parts. The interplay in accordance with the invention of the insertion part and the spring element can therefore be transferred to a plurality of different plug connector types and can thus be used with particular versatility.

Advantageous embodiments of the invention can be seen from the dependent claims, from the description and from the drawing.

In accordance with a preferred embodiment, the insertion part can be at least partly pulled out from the first plug part by the second plug part against the restoring force of the spring element on the separation of the plug parts.

The insertion part is therefore not only acted on by a force, on the joining together of the plug parts, but also on the pulling apart of the plug parts, and indeed by a force which acts against the direction of pulling. A separation of the plug parts is therefore only possible while overcoming the restoring force of the spring element. As long as this is not completely overcome, the second plug part is continually plugged into the first plug part by the spring element and the completely plugged together state of the plug connector is maintained.

The spring element therefore has the effect that electrical connection elements provided in the plug parts are either correctly connected to one another or completely separated from one another. Both states can be recognized directly with reference to the respective relative arrangement of the two plug parts.

The result is therefore that a go/no go function is achieved not only on the joining together of the plug parts, but also on the separation of the plug parts. Furthermore, the restoring force of the spring element to be overcome to separate the plug parts represents a form of latching of the plug connector.

In accordance with a further embodiment, the spring element is made such that it switches from a maximally tensioned state into a substantially relaxed state on the plugging together of the plug parts or on a separation of the plug parts.

The spring element is preferably not uncoupled from the insertion part in this process, but it rather also cooperates with the insertion part after the switching over into the relaxed state. The switching over of the spring element thus contributes to bringing the second plug part into the desired end position, i.e. to pull the second plug part completely into the first plug part or to achieve a complete separation of the plug parts.

In accordance with a particularly preferred embodiment, two spring elements are provided which are arranged at oppositely disposed sides of the first plug part. An at least approximately symmetrical distribution of the restoring forces is thereby achieved and, for example, a canting of the plug parts on the plugging together or separation of the plug connector is prevented. The reliability of the function of the plug connector is thereby increased even further.

A latching element is advantageously provided for the latching of the insertion part to the second plug part. This permits, on the one hand, a securing of the second plug part to the insertion part in the joined together state of the plug connector and, on the other hand, a displacement of the insertion part against the restoring force of the spring element when the second plug part is pulled out of the first plug part to separate the plug connector.

In accordance with a further embodiment, a securing means is in particular provided at the first plug part in order to secure a latching element of the insertion part in a latching position in the completely plugged together state of the plug connector. The securing means in other words prevents an unintentional unlatching of the insertion part and the second plug part.

It is furthermore particularly advantageous for the first plug part to be secured to the second plug part by the securing means in the completely plugged together state of the plug connector. The securing means therefore satisfies a dual function in this case in that it secures the latching of the insertion part and the second plug part, on the one hand, and provides a latching of the first plug part to the second plug part, on the other hand. In the event that the plug parts can only be separated from one another while overcoming the restoring force of the spring element, the securing means therefore represents an additional latching of the joined together plug connector.

Figure 2:
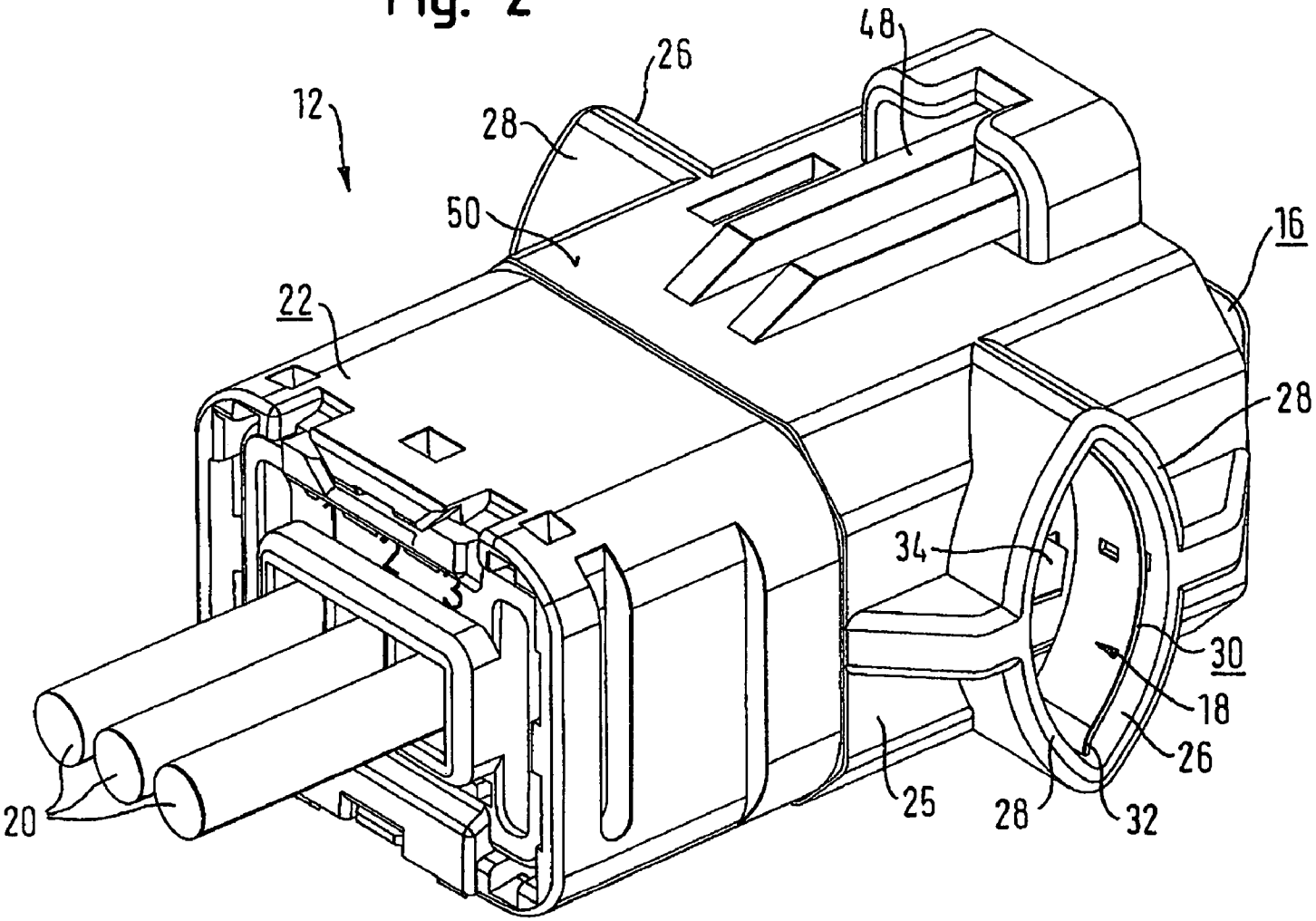
Figures 3A, 3B, 3C:
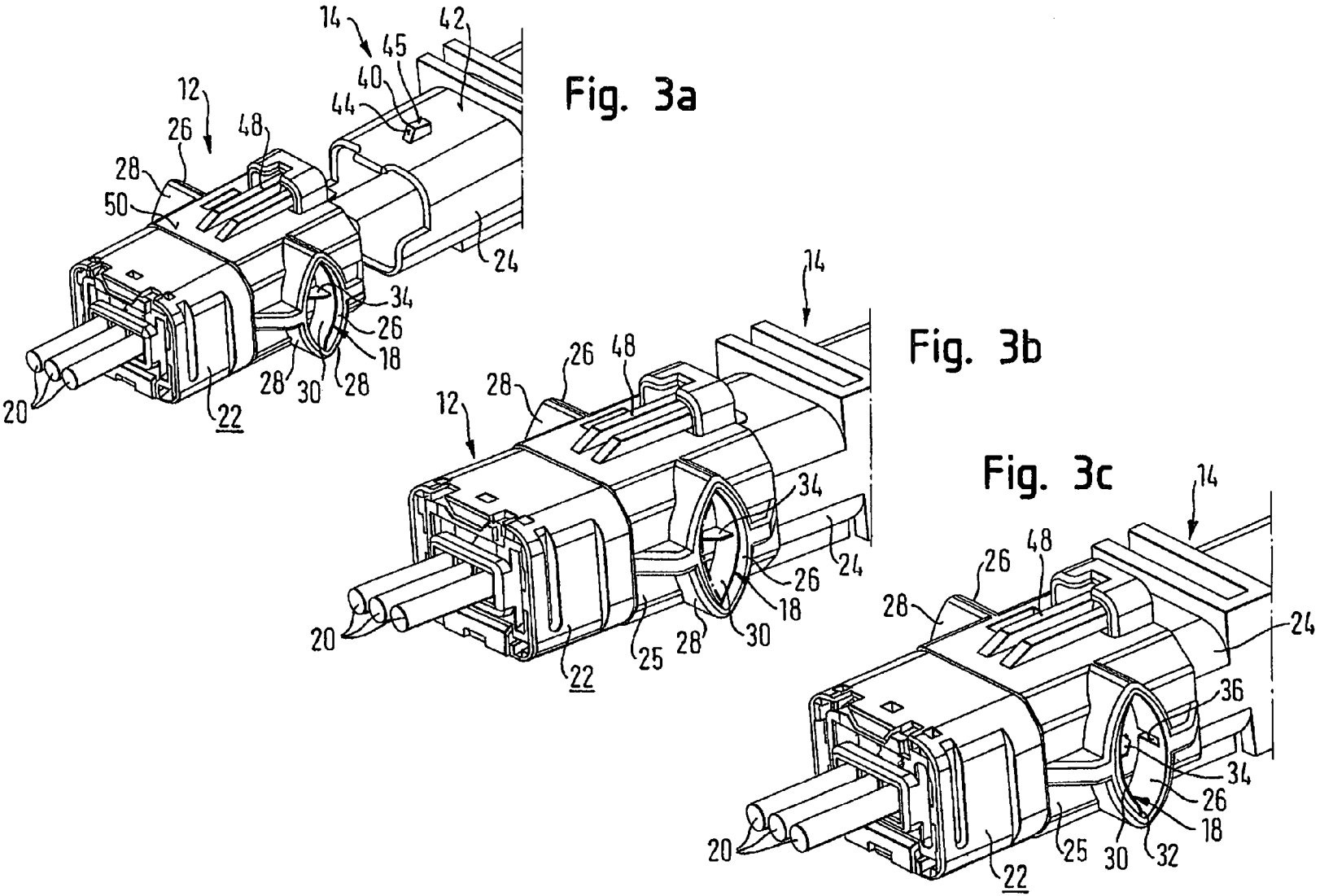
Figure 4:
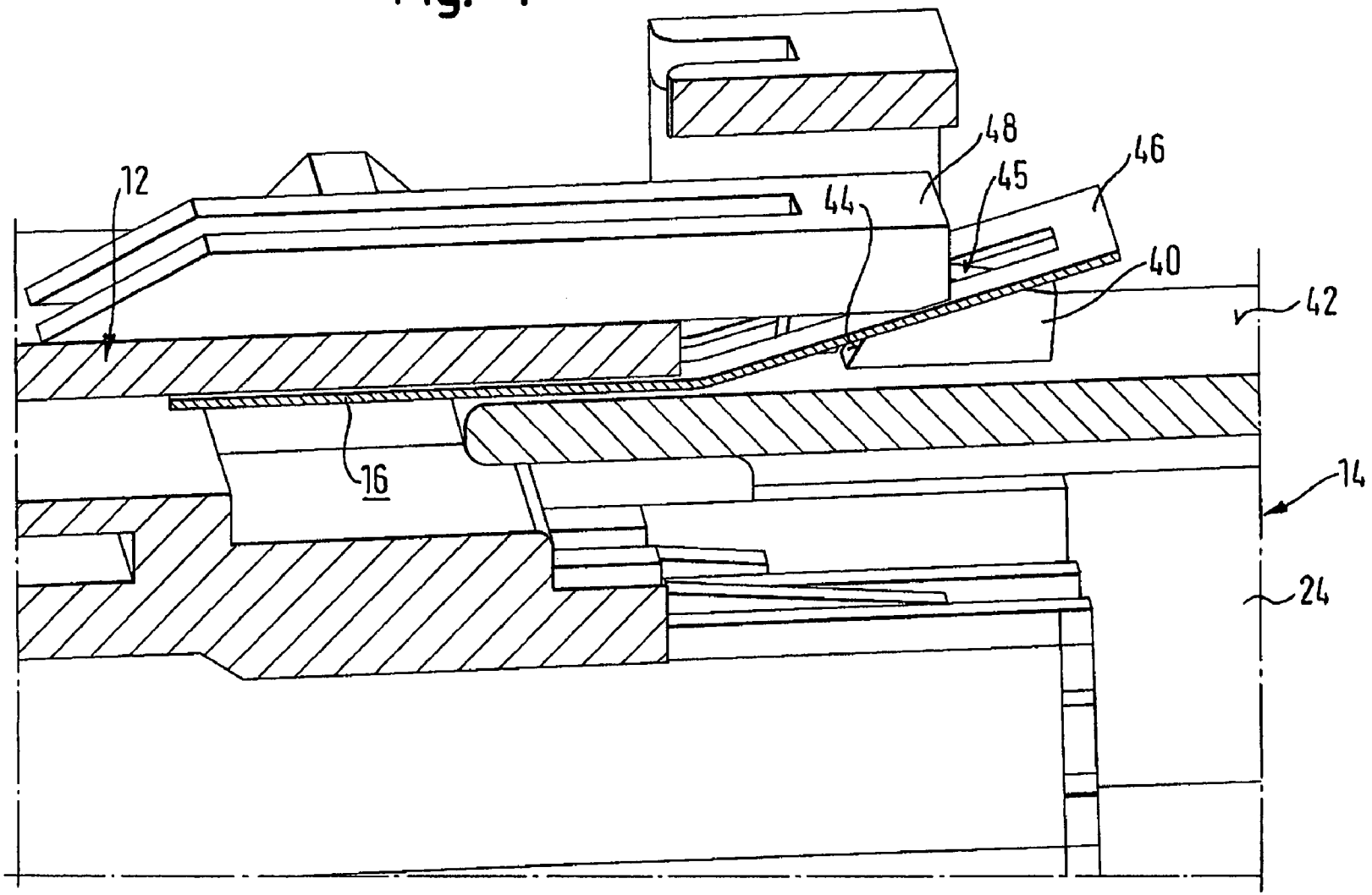
Figure 5:
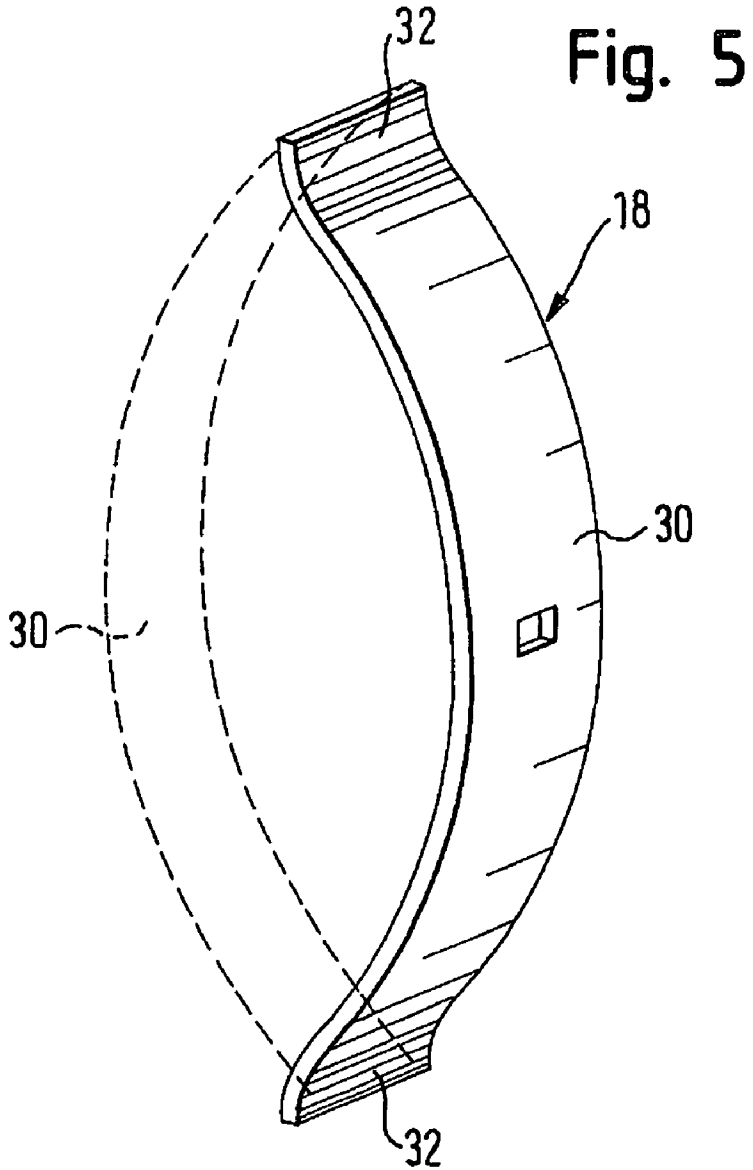
Figure 7:
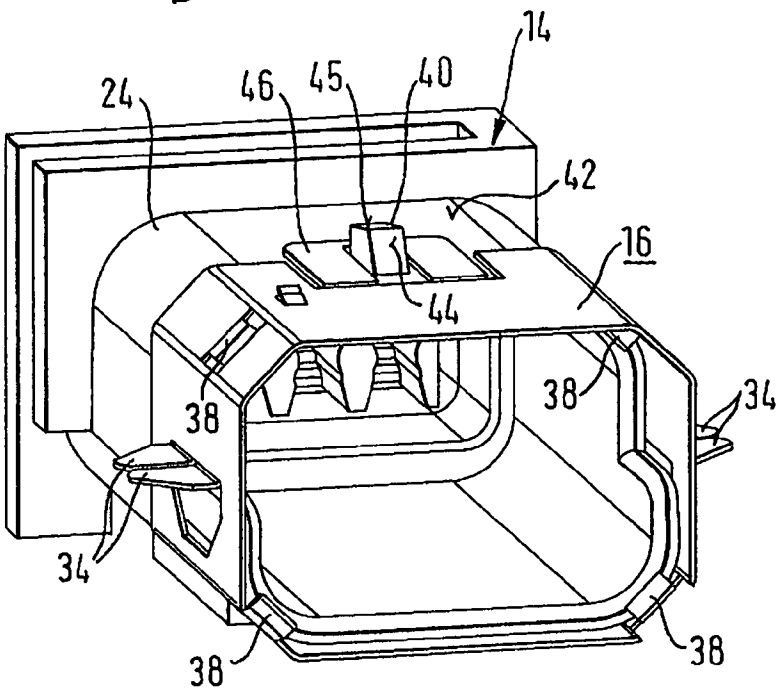
Figure 6:
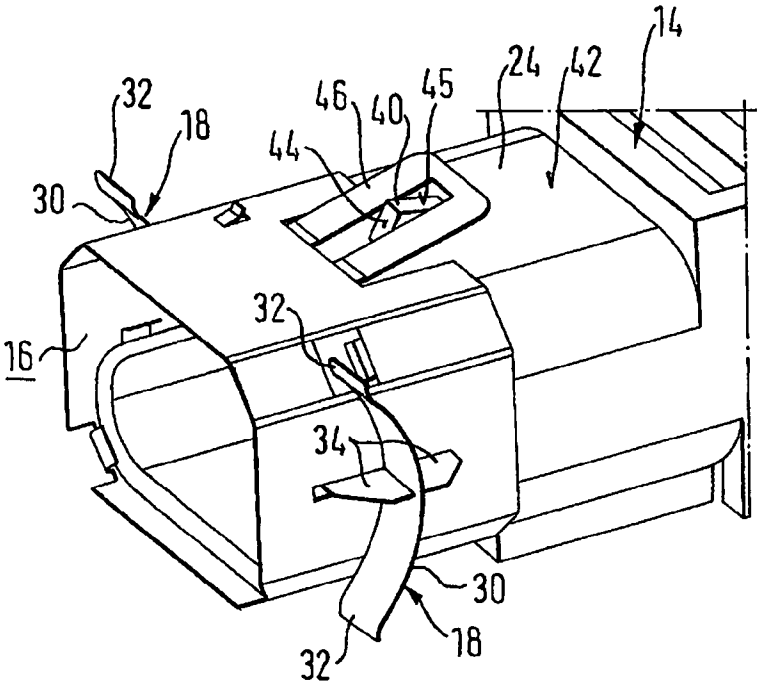

The invention will be described in the following purely by way of example with reference to an advantageous embodiment and to the enclosed drawing. There are shown:

FIG. 1 an exploded view of a plug connector in accordance with the invention;

FIG. 2 a perspective view of a first plug part of the plug connector of FIG. 1 in an assembled state;

FIGS. 3A-C relative positions of a first plug part and a second plug part of the plug connector of FIG. 1 during the plugging together of the plug parts;

FIG. 4 a cross-sectional view of a latching arrangement of the plug connector of FIG. 1;

FIG. 5 positions of rest of a spring element of the plug connector of FIG. 1 in the separated and completely plugged together state of the plug connector;

FIG. 6 a perspective view of an insertion part and of a second plug part of the plug connector of FIG. 1 in the partly joined together state of the plug connector; and FIG. 7 a perspective view of the insertion part and of the second plug part of FIG. 6 in the completely plugged together state of the plug connector.

The electrical plug connector 10 shown in FIG. 1 includes a first plug part 12, a second plug part 14 which can be plugged into the first plug part 12, an insertion part 16 and two spring elements 18.

Electrical connection elements are provided both in the first plug part 12 and in the second plug part 14 and are electrically connected to one another by the plugging together of the plug connector 10. In FIG. 1, three electrical leads 20 are shown by way of example which lead into the first plug part 12 and are each connected to a connection element of the first plug part 12.

The first plug part 12 includes a housing 22 which bounds a reception space for the reception of a stub section 24 of the second plug part 14. The first plug part 12 has an introduction opening for the introduction of the stub section 24 at an end face of the housing 22 remote from the electrical leads 20.

The insertion part 16 is displaceably supported in the reception space of the first plug part 12. The insertion part 16 is sleeve-shaped, with the outer cross-section of the insertion part 16 being matched to the cross-section of the receiving space of the first plug part 12 and the inner cross-section of the insertion part 16 being matched to the outer cross-section of the stub section 24.

On the plugging together of the plug connector 10, the stub section 24 of the second plug part 14 introduced into the reception space of the first plug part 12 is surrounded by the insertion part 16. In this process, the housing 22 of the first plug part 12, the insertion part 16 and the stub section 24 of the second plug part 14 are displaceable relative to one another in an axial direction A extending parallel to the plug-in direction.

As FIGS. 1 and 2 show, a respective spring support 26 is provided at oppositely disposed housing sides 25 of the first plug part 12 and serves for the support of a respective one of the spring elements 18. Each spring support 26 is formed by two wall sections 28 which start from the housing 22, extend perpendicular to the axial direction A, are curved and extend convexly to one another.

The two spring elements 18 of the embodiment shown are made in the manner of a leaf spring and each include a bent forward, strip-shaped resilient sheet metal 30. Generally, however, a different type and/or a different number of spring elements can also be used. Optionally, the spring supports of the first plug part are to be matched accordingly.

Each spring element 18 is inserted into its associated spring support 26 such that end sections 32 of the spring plate 30 are each fixed in a region of the spring support 26 in which the wall sections 28 converge. The curvature of the wall sections 28 and the bending forward of the spring plates 30 are matched to one another such that the spring plates 30 extend substantially parallel to a wall section 28 in the relaxed state of a spring element 18. This applies both to the case that the resilient sheet metal 30 is bent in the direction of the second plug part 14 (FIG. 2) and to the case that the resilient sheet metal 30 is bent away from the second plug part 14, as shown by the broken line in FIG. 5.

As FIGS. 1 and 6 show, the insertion part 16 has a support for each spring element 18. Each support is formed by two wing-like shoulders 34 which are spaced apart in the axial direction A, face outwardly and between which the associated spring plate 32 can be received.

The insertion part 16 is first pushed into the housing 22 for the assembly of the first plug part 12. Axially extending guide slots 36 for the shoulders 34 of the insertion part 16 are provided in this process both in the housing sides 25 and in the wall sections 28 of the spring support 26 facing toward the introduction opening.

The insertion part 16 is introduced so far into the housing 22 that the spring elements 18 can be inserted into their respective spring support 26 with a curvature of the spring plate 30 facing in the direction of the introduction opening and can be brought into engagement with the respective support of the insertion part 16. The spring plates 30 are, in other words, pushed between the shoulders 34 from the outside. The movement of the insertion part 16 relative to the housing 22 is thereby bounded in the axial direction A.

The plugging together of the plug connector 10 will now be described with reference to FIG. 3.

FIG. 3A shows a situation in which the plug parts 12, 14 are still out of engagement, i.e. are completely separated from one another. In this situation, the spring elements 18 are in a position of rest in which the spring plates 30 are each curved in the direction of the second plug part 14 and are substantially curved parallel to the wall sections 28 facing in the direction of the introduction opening of the first plug part 13.

The second plug part 14 is pushed so far into the reception space of the first plug part 12 until the stub section 24 of the second plug part 14 abuts stops 38 of the insertion part 16 provided for this purpose.

If the second plug part 14 is moved even further into the first plug part 12, the insertion part 16 is also displaced in the plug-in direction relative to the housing 22 of the first plug part 12 by the stub section 24 cooperating with the stops 38 of the insertion part 16.

The displacement of the insertion part 16 in the plug-in direction effects a deformation of the spring plates 30 supported between the shoulders 34 of the insertion part 16 in the plug-in direction. The spring elements 18 are thereby tensioned and the plugging together of the plug parts 12, 14 takes place against the restoring force of the spring elements 18.

If the plug-in force exerted onto the second plug part 14 in this situation falls below the restoring force of the spring elements 18, for example when the second plug part 14 is released, the second plug part 14 is pressed out of the first plug part 12 again by the spring elements 18.

If, in contrast, the second plug part 14 is pushed even further into the first plug part 12, the deformation of the spring elements 18 reaches a point at which the spring plates 30 switch over, i.e. move from a curvature facing the second plug part 14 into a curvature facing away from the second plug part 14. This switch-over point follows on directly from a state of maximum strain of the spring elements 18.

After the switching over of the spring elements 18, the forces exerted onto the insertion part 16 and thus onto the second plug part 14 by the spring elements 18 no longer act against the plug-in direction, but in the plug-in direction. The second plug part 14 is pulled into the first plug part 12 by the switched over spring elements 18 and the plug connector 10 is brought into a completely plugged together state via a latching element 46 of the insertion part 16 cooperating with a latch projection 40 of the second plug part 14 which will be explained in more detail in the following.

In this state, the spring elements 18 adopt the position of rest shown by a broken line in FIG. 5 in which the spring plates 30 extend substantially parallel to the wall sections 28 of the spring supports 26 facing away from the second plug part 14. In the position of rest, the spring elements 18 are substantially relaxed so that they do not exert any significant forces onto the insertion part 16.

If the plug parts 12, 14 are to be separated again, the restoring forces of the switched over spring elements 18 must be overcome. The switched over spring elements 18 thus so-to-say effect a first latching of the plug connector 10.

Furthermore, an additional mechanism for the latching of the plug connector 10 is provided which will be explained in the following in connection with FIGS. 1, 4, 6 and 7.

As the Figures show, a latch element 40 is arranged at an upper side 42 of the stub section 22 of the second plug part 14. The latch projection 40 has a front slanted surface 44 at its front side facing toward a first plug part 12. Furthermore, the upper side of the latch projection 40 has an upper slanted surface 45 which falls off to the rear, i.e. in the direction facing away from the first plug part 12.

A latching element is provided at the insertion part 16 which is formed by a resilient tab 46 which faces toward the second plug part 14 and is displaced obliquely outwardly with respect to the axial direction A. The latching tab 46 is arranged such that it is located above the latch projection 40 of the second plug part 14 as soon as the first stub section 24 of the second plug part 14 abuts the stops 38 of the insertion part 16 (FIG. 6).

Furthermore, a latch arm 48 is provided at an upper side 50 of the housing 22 of the first plug part 12 which extends in the axial direction A in order to latch behind the latch projection 40 of the second plug part 14 in the completely plugged together state of the plug connector 10.

If the second plug part 14 is pushed even further into the first plug part 12 on the plugging together of the plug connector 10, starting from the situation in which the stub section 24 first abuts the stops 38 of the insertion part 16 (FIG. 6), the spring elements 18 are deformed, as was already described above.

At the same time, the latch spring arm 48 runs onto the front slanting surface 44 of the latch projection 40, whereby the latch spring arm 48 is pressed outwardly.

If the second plug part 14 is pushed even further into the first plug part 12, the latch spring arm 48 moves beyond the upper sloping oblique surface 45 of the latch projection 40. In this process, the latch spring arm 48 comes the closer to the upper side 42 of the stub section 22, the further the latch spring arm 48 is pushed over the latch projection 40.

By this gradual approaching toward the upper side 42, the latching tab 46 is gradually pressed inwardly, i.e. in the direction of the upper side 42 of the stub section 22, so that the latching tab 46 engages behind the latch projection 40 at the latest at that moment in which the spring elements 18 switch over to pull the second plug part 14 into the first plug part 12.

As soon as the plug connector 10 achieves its completely plugged-together state, the latch spring arm 48 latches behind the latch projection 40. The latching tab 46 is pressed toward the upper side 42 of the stub section 22 by the latched spring arm 48 and is held in a latching position in which the latching tab 46 engages behind the latch projection 40. In the plugged together state of the plug connector 10, not only the first plug part 12 is consequently secured by the latch spring arm 48, but the insertion part 16 is also secured to the second plug part 14 by the latching tab 46.

To separate the plug parts 12, 14 from one another, only the latch spring arm 48 has to be raised above the latch projection 40 and the second plug part 14 has to be pulled out of the first plug part 12.

While the plug parts 12, 14 are pulled apart, the latching tab 46 gradually moves outwardly again, i.e. away from the upper side 42 of the stub section 22. The latching tab 46 engages behind the latch projection 40 for as long as is necessary to move the insertion part 16 against the restoring force of the spring elements 18. In that moment in which the spring elements 18 switch over again, the latching tab 46 releases the latch projection 40 so that the second plug part 14 can be completely pulled out of the first plug part 12.

The invention claimed is:

1. A An electrical plug connector comprising;

a first plug part;

a second plug part which can be plugged together with the first plug part; and an insertion part, which is supported displaceably at the first plug part in the plug-in direction and cooperates with at least one spring element of the first plug part;

wherein the insertion part is able to be pushed into the first plug part by the second plug part against the restoring force of the spring element on the plugging together of the plug parts;

wherein the spring element is substantially relaxed with separated plug parts and in the completely plugged together state of the plug connector, and wherein a latch spring arm is provided at the first plug part which latches behind a latch projection of the second plug part in the completely plugged together state of the plug connector and in this process secures a latching element of the insertion part engaging behind the latch projection.

2. A plug connector in accordance with claim 1, wherein the insertion part can be at least partly pulled out of the first plug part by the second plug part against the restoring farce of the spring element on the separation of the plug parts.

3. A plug connector in accordance with claim 1 wherein the spring element is made such that it switches over from a maximally tensioned state into a substantially relaxed state on the plugging together of the plug parts and/or on a separation of the plug parts.

4. A plug connector in accordance with claim 1, wherein the spring element is made as a plate spring.

5. A plug connector in accordance with claim 1, wherein two spring elements are provided which are arranged at oppositely disposed sides of the first plug part.

6. A plug connector in accordance with claim 1, wherein the insertion part has stops which permit a supporting of the second plug part at the insertion part.

7. A plug connector in accordance with claim 1, wherein the insertion part is sleeve shaped and the cross-section of the insertion part is matched to an inner cross-section of the first plug part and to an outer cross-section of the second plug part.

8. A plug connector in accordance with claim 1, wherein a latch projection is provided at the second plug part which can be engaged behind by a latching element of the insertion part in the completely plugged together state of the plug connector.

9. A plug connector in accordance with claim 1, wherein the insertion part has a support for each spring element.

10. A plug connector in accordance with claim 9, wherein each support is formed by two shoulders, wherein said shoulders are spaced apart in the plug direction, wherein said shoulders face outwardly, and wherein the associated spring element can be received between said shoulders.

11. A plug connector in accordance with claim 1, wherein a latching element is provided for the latching of the insertion part to the second plug part.

12. A plug connector in accordance with claim 11, wherein the latching element is formed by a resilient latching tab provided at the insertion part and moved slantingly outwardly with respect to the plug-in direction.

13. An electrical plug connector, comprising:

a first plug part;

a second plug part which can be plugged together with the first plug part; and an insertion part, which is supported displaceably at the first plug part in the plug-in direction and cooperates with at least one spring element of the first plug part;

wherein the insertion part is able to be pushed into the first plug part by the second plug part against the restoring force of the spring element on the plugging together of the plug parts;

wherein the spring element is substantially relaxed with separated plug parts and in the completely plugged together state of the plug connector;

wherein a securing means is in particular provided at the first plug part to secure a latching element of the insertion part in a latching position in the completely plugged together state of the plug connector; and wherein the first plug part is secured to the second plug part by the securing means in the completely plugged together state of the plug connector.

* * * * *